United States Patent [19]

Kathriner

[11] Patent Number: 4,577,666

[45] Date of Patent: Mar. 25, 1986

[54] WEFT YARN TENSIONING DEVICE

[75] Inventor: Josef Kathriner, Kollbrunn, Switzerland

[73] Assignee: Sulzer Brothers Limited, Winterthur, Switzerland

[21] Appl. No.: 601,701

[22] Filed: Apr. 18, 1984

[30] Foreign Application Priority Data

Apr. 28, 1983 [DE] Fed. Rep. of Germany ..... 3315433

[51] Int. Cl.[4] ..... D03D 47/34

[52] U.S. Cl. ..... 139/450; 139/190

[58] Field of Search ..... 139/190, 429, 435, 446, 139/450; 74/567, 568 R

[56] References Cited

U.S. PATENT DOCUMENTS 2,604,123 7/1952 Budzyna et al. ..... 139/446

2,654,399 10/1953 Berry et al. ..... 139/446

2,665,716 1/1954 Budzyna et al. ..... 139/450

2,749,946 6/1956 Pfarrwaller ..... 139/450

*Primary Examiner*—Henry S. Jaudon

*Attorney, Agent, or Firm*—Kenyon & Kenyon

[57] ABSTRACT

The weft yarn tensioning device has a tensioning lever whose yarn-tensioning and yarn-releasing movements are controlled positively by means of two cams. An adjusting element is disposed between the cams and is provided with a cam segment adjacent a respective cam. The camming surfaces of the cam segments each form a continuation of the camming surface of an associated cam for the release movement of the tensioning lever. The cam segments can be adjusted relative to the cams so that the pattern of the release movement is adapted to the quality of the weft yarn.

8 Claims, 9 Drawing Figures

WEFT YARN TENSIONING DEVICE

This invention relates to a weft yarn tensioning device for a weaving machine.

As is known, weaving machines are frequently provided with various types of weft yarn tensioning devices in order to insure proper tension in a weft yarn for picking. In many cases, the weft yarn tensioning device includes a tensioning lever which is able to deflect the weft yarn before picking so that the weft yarn extends in a loop in relation to a picking line. At or shortly before picking, the lever is usually moved towards the picking line so that the weft yarn can be released for picking into a shed. In order to control the movement of the tensioning lever between a yarn-tensioning position and a yarn-releasing position, use has been made of a cam follower lever having follower rolls which are guided in a positive manner on cams.

As is also known, the beginning and nature of a release movement of a tensioning lever has to be varied in dependence upon the nature of the weft yarn. This adaptation can, of course, be achieved by interchanging the cams. However, such a cam interchange is time-consuming and thus a disadvantage of the tensioning device.

Accordingly, it is an object of the invention to provide a weft yarn tensioning device which permits rapid adaptation of the device to a weft yarn to be processed.

It is another object of the invention to permit a relatively easy means for adjusting a weft yarn tensioning device.

Briefly, the invention provides a weft yarn tensioning device for a weaving machine which is comprised of a tensioning lever for movement between a yarn-tensioning position and a yarn-releasing position, a cam follower lever which mounts the tensioning lever thereon and a pair of follower rolls rotatably mounted on the follower lever. In addition, the tensioning device has a pair of cams, each of which has a control surface for guiding a respective roll and at least one adjusting element between the cams for controlling a movement of the tensioning lever. This adjusting element has a pair of cam segments each of which has a control surface defining a continuation of the control surface of a respective cam.

By adjusting the adjusting element relative to the cams, the points at which movement of the tensioning lever from a yarn-tensioning position or from a yarn-releasing position can be readily made without having to interchange the cams.

The adjusting element can be provided with a suitable means for limiting relative movement between the element and the cams. For example, the means may include an arcuate groove in one of the cams and a pin which extends from one of the cam segments into the groove.

In another embodiment, the tensioning device may be provided with a pair of adjusting elements which are disposed in concentric relation for controlling two movements of the tensioning lever. In this embodiment, one adjusting element can be used to adjust the point of movement of the tensioning lever to the yarn-tensioning position while the other adjusting element is used to adjust the point of movement of the tensioning lever to the yarn-tensioning releasing position.

These and other objects and advantages of the invention will become more apparent from the following detailed description taken in conjunction with the accompanying drawings wherein.

Figure 1:
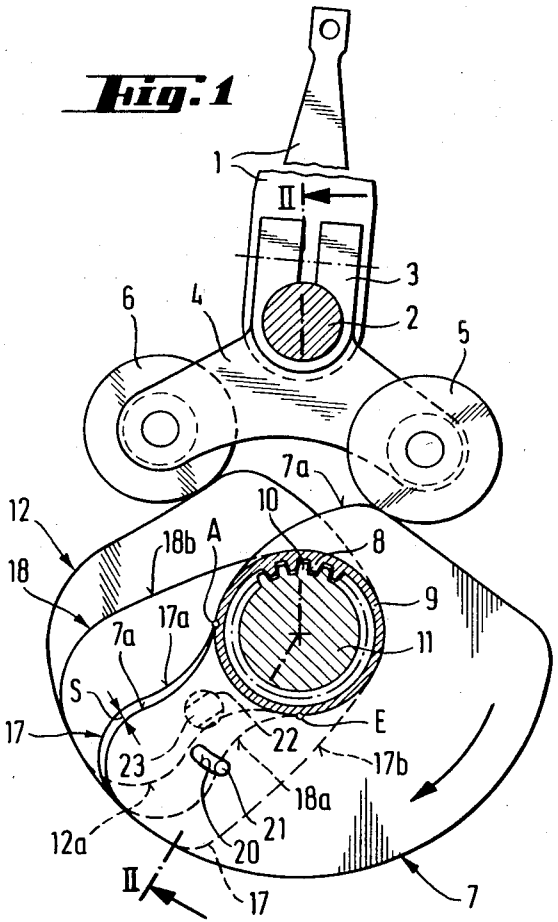
FIG. 1 illustrates a view of a weft yarn tensioning device in accordance with the invention taken on line I—I of FIG. 2.
Figure 9:
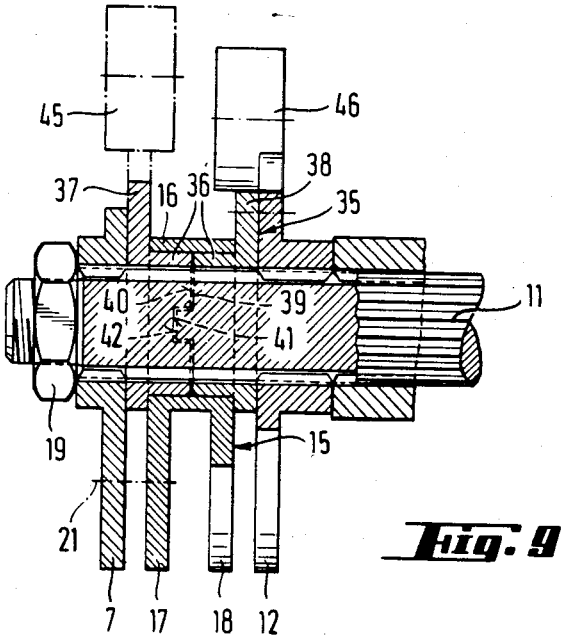
Figure 6:
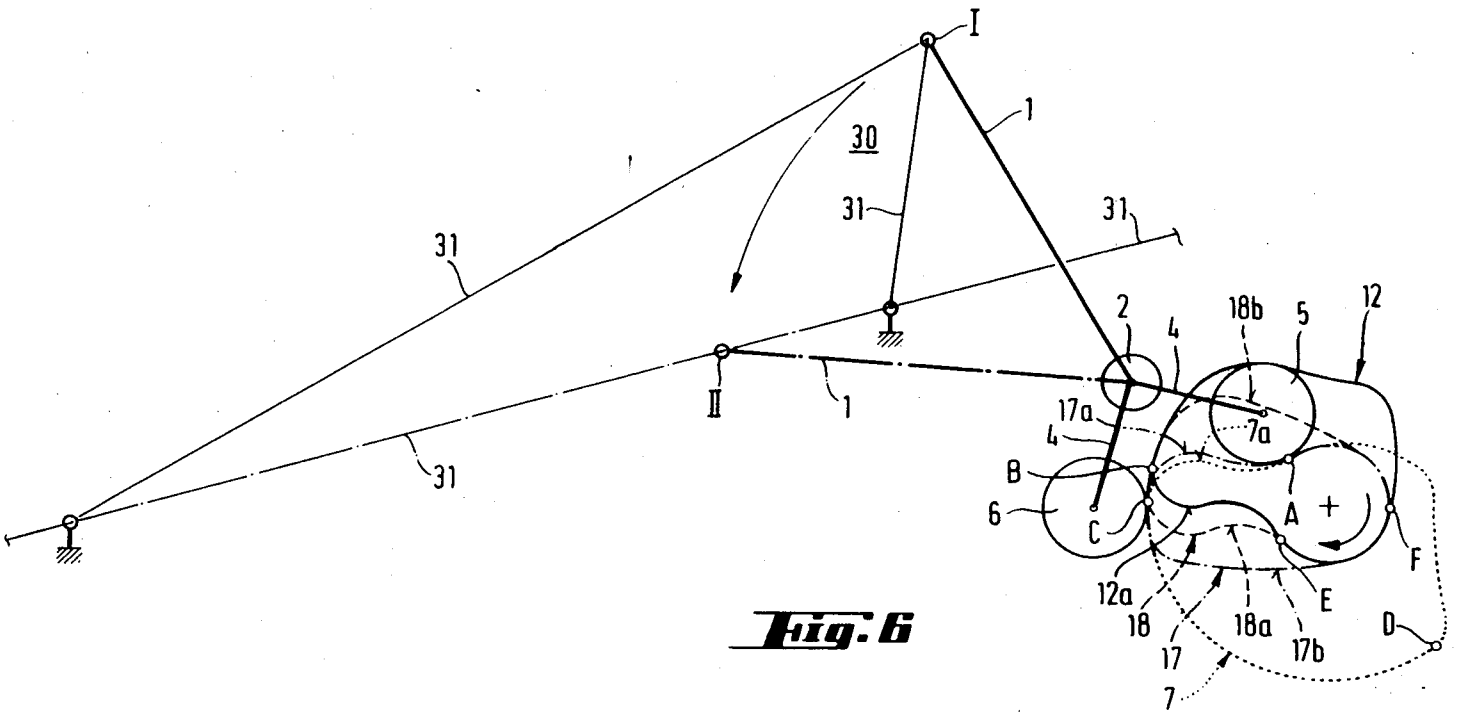
Figure 7:
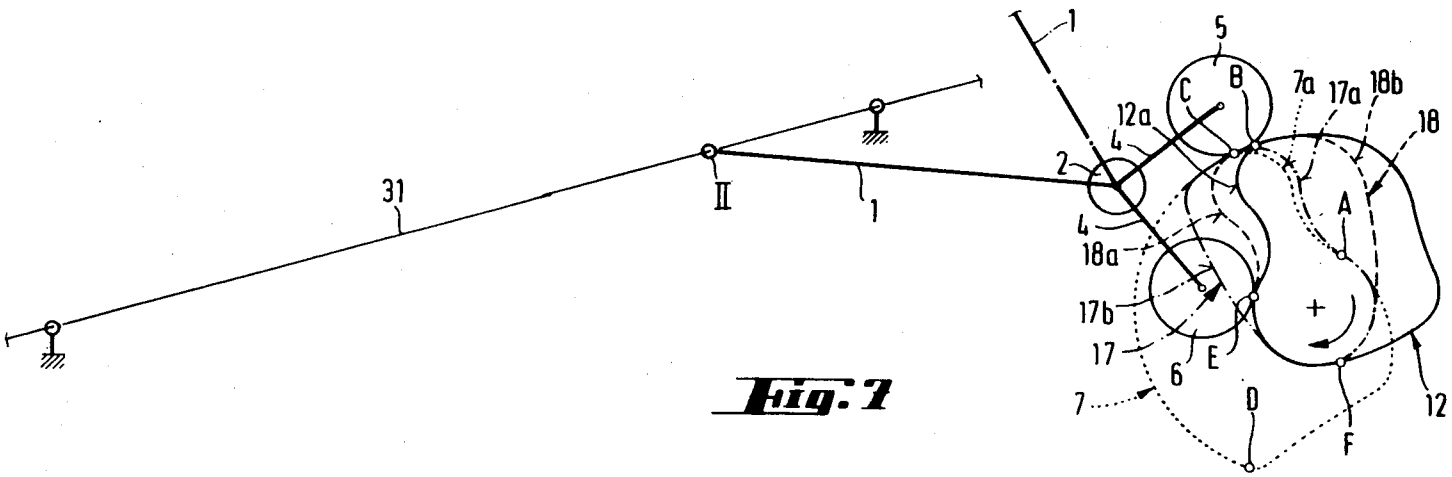
Figure 8:
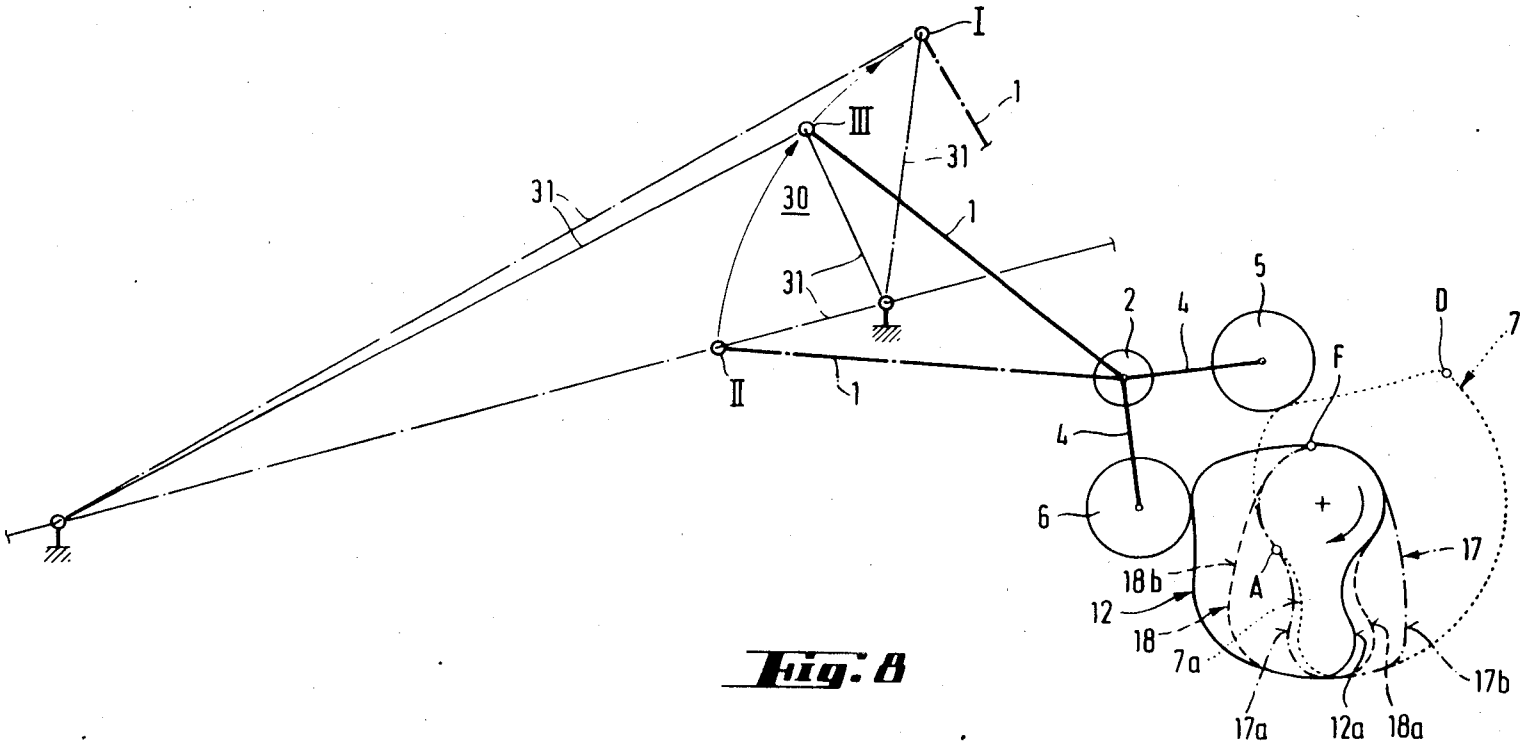

FIG. 6 diagrammatically illustrates a yarn-tensioning position of a tensioning lever of the tensioning device of FIG. 1;

FIG. 7 illustrates a yarn-releasing position for the tensioning lever of FIG. 1;

FIG. 8 illustrates an intermediate position of the yarn tensioning lever; and FIG. 9 illustrates a modified weft yarn tensioning device employing a pair of adjusting elements in accordance with the invention.

Referring to FIG. 1, the weft yarn tensioning device includes a tensioning lever 1 which is secured to a shaft 2 for pivoting about the axis of the shaft between a yarn-tensioning position and a yarn-releasing position. In addition, a cam follower lever 4 is mounted on the shaft 2 and is secured to the tensioning lever 1 by means of a clamp 3. The follower lever 4 has a pair of follower rolls 5, 6 rotatably mounted on opposite ends in known manner.

Figure 2:
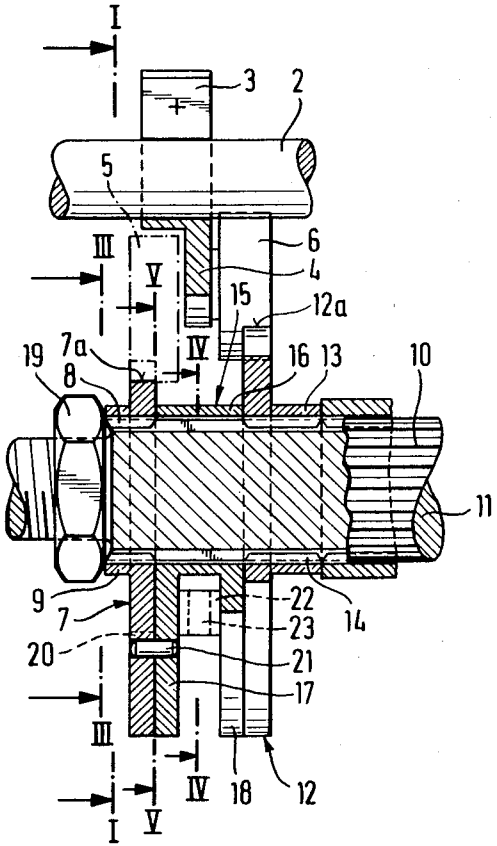
FIG. 2 illustrates a view taken on line II—II of FIG. 1 but without illustration of the tensioning lever.

The tensioning device also has a cam assembly for pivoting the cam follower lever 4 to move the tensioning lever 1 between the yarn-tensioning position and the yarn-releasing position. This cam assembly includes a drive shaft 11 which is driven by a main shaft (not shown) of a weaving machine and a pair of cams 7, 12 which are mounted on the drive shaft 11. As indicated in FIG. 2, the cam 7 is connected to the drive shaft 11 by means of internal splining 8 in a hub 9 of the cam 7 and of external toothing 10 on the shaft 11. Likewise, the cam 12 has a hub 13 which is provided with internal splining 14 which engages with the external splining 10 of the drive shaft 11. Each cam 7, 12 also has a camming or control surface *7a*, *12a* which extends radially of the cam 7, 12. As indicated in FIGS. 1 and 2, the roll 5 is guided on the cam 7 while the roll 6 is guided on the cam 12.

In addition, the cam assembly has an adjusting element 15 between the cams 7, 12 and about the shaft 11. The adjusting element is embodied by a hub 16 and a pair of cam segments 17, 18 for adjusting the point of movement of the tensioning lever 1 from one of the yarn tensioning position and yarn releasing position to the other. Each cam segment 17, 18 has a control surface which, in part, defines a continuation of the control surface of a cam 7, 12. For the sake of clarity, the boundary lines of the two cam segments 17, 18 are provided with reference characters 17*a*, 17*b* and 18*a*, 18*b*; the boundary lines 17*a* and 18*a* defining the camming or control surfaces.

The cams 7, 12 and adjusting element 15 are so secured by a nut 19 (see FIG. 2) to the shaft 11 as to co-rotate therewith. As shown, the hub 16 is void of any internal splining and extends around the outer splining 10 of the shaft 11 so that after the nut 19 has been loosened, the adjusting element 15 with the cam segments 17, 18 can be rotated relative to the cam 7, 12 and the shaft 11.

Referring to FIGS. 1 and 2, the cam assembly is provided with a means for limiting relative movement between the adjusting element 15 and the cams 7, 12. As indicated, this means includes an arcuate groove 20 in the cam 7 and a pin 21 which extends from the cam segment 17 into the groove 20. This means thus provides a range of adjustment S of the cam segment 17 relative to the cam 7. Further, the range of adjustment is determined by the length of the groove 20.

Figure 4:
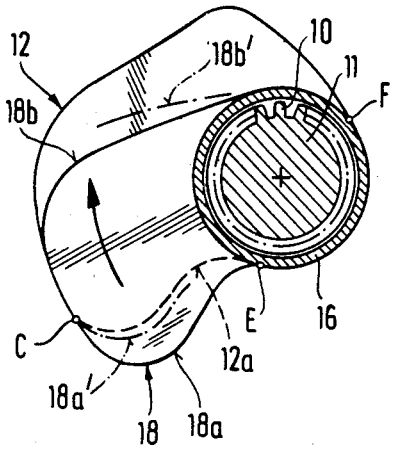
FIG. 4 illustrates a view taken on line IV—IV of FIG. 2.

Referring to FIG. 2, the boundary lines 17*a*, 17*b* of the cam segments 17 at maximum deflection are indicated by lines 17*a*', 17*b*', respectively. The boundary lines 18*a*, 18*b* of the cam segment 18 are indicated in corresponding manner by lines 18*a*', 18*b*' in FIG. 4.

Figure 5:
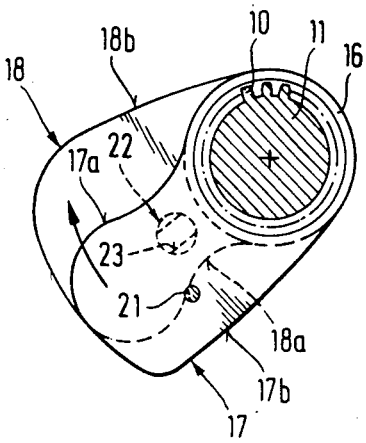
FIG. 5 illustrates a view taken on line V—V of FIG. 2 of an adjusting element.

Referring to FIGS. 2 and 5, a connecting element 22 is disposed between the two cam segments 17, 18 and is provided with a bore 23. This permits the adjusting element 15 to be turned by means of a pin, such as a screwdriver, introduced into the bore 23.

In use, the cams 7, 12 are usually adjusted on the drive shaft 11 so as to accommodate a particular weft yarn to be picked. Should a need arise to make an adjustment in the movements of the tensioning lever, the nut 19 is loosened and the adjusting element 15 is rotated through a corresponding angle to adjust the cam segments 17, 18 simultaneously relative to the cams 7, 12 to suit the nature of the weft yarn to be picked. Thereafter, the nut 19 is tightened to fix the new position of the adjusting element 15.

Referring to FIG. 6, the tensioning lever 1 is shown in a yarn-tensioning position I ready for movement to the yarn-releasing position II. FIG. 7 illustrates the tensioning lever 1 in the yarn-releasing position II.

In order to explain the phase of movement of the tensioning lever 1 from the start of the release movement to the end of the release movement of the lever 1, the cam 7 is shown in dotted line, the associated cam segment is shown in dash-dotted line, the cam 12 is shown in solid line and the associated cam segment is shown in chain line. As the cams and segments rotate clockwise during operation of the weaving machine, the follower roll 5 changes over at the start of the release movement approximately at point A (see also FIG. 1) from the cam 7 to the camming surface 17*a* of the cam segment 17. The roll 5 remains in contact with the cam segment 17 only until approximately point B. Also, at the start of the release movement, the follower roll 6 changes over approximately at point C from cam 12 to camming surface 18*a* of cam segment 18 and remains in contact with the cam segment 18 as far as approximately point E. The release movement terminates for the follower roll 5 approximately at point B and for follower roll 6 at point E. In this release movement the tensioning lever 1 moves from the upper position I to the lower position II so that a loop 30 of weft yarn 31 is dissipated into a picking line.

During the movement of the roll 5 from point B to D and of roll 6 from point E to point F (see FIG. 7), the lever 1 remains in the lower or inoperative position. During this inoperative period, the weft yarn 31 is picked. The yarn-tensioning movement resumes at point D and point F, respectively.

Referring to FIG. 8, during movement of the lever 1 from the inoperative position II to the yarn-tensioning position I, the lever 1 passes through an intermediate position III. As indicated, the weft yarn is formed into a loop 30 during this time and up to the point at which the tensioning lever 1 arrives at the uppermost position I as viewed.

Of note, although the adjusting element 15 has been described as varying the release movement, the element 15 can, of course, be used instead to vary the yarn-tensioning movement.

Referring to FIG. 9, wherein reference characters indicate like parts as above, the tensioning device may be provided with a pair of adjusting elements 15, 35 for respectively controlling the point of movement for the yarn-releasing movement and the yarn-tensioning movement. As illustrated, the second adjusting element 35 is disposed concentrically inside the adjusting element 15 about the drive shaft 11 and between the cams 7, 12. In addition, the adjusting element 35 is formed by a split hub 36 and two cam segments 37, 38 which cooperate with the cams 7, 12 in a manner as described above.

The halves of the hub 36 have end faces 39, 40 which are formed alternately with recesses 41 and projections 42 in meshing relation so that the two cam segments 37, 38 are located relative to each other. As described above with respect to FIGS. 1 and 2, the range of adjustment of the cam segments 37, 38 relative to the cams 7, 12 is determined by the length of a groove (not shown) in one of the cams and by a pin which is guided in the groove and associated with a cam segment 37, 38.

In use, after the nut 19 has been loosened on the drive shaft 11, the adjusting element 35 with the cam segments 37, 38 can be turned into the required position relative to the cam 7, 12, for example, to adjust the yarn tensioning movement of the tensioning lever 1. The nut 19 can then be tightened to permit operation to proceed as described above. If required, the adjusting element 15 can also be turned into a new position relative to the cam 7, 12 so that the yarn-releasing movement of the tensioning lever 1 is adapted to the yarn quality.

In this embodiment, the width of the follower rolls 45, 46 correspond to the total width of the associated cam 7, 12 and the two cam segments 17, 37; 18, 38.

The invention thus provides a weft yarn tensioning device which can be readily adjusted from time to time so as to adapt to the quality and nature of a weft yarn being picked in a weaving machine. In this respect, adjustments can be made in the movement of the tensioning lever without need to remove the cams from the drive shaft.

What is claimed is:

1. A weft yarn tensioning device for a weaving machine comprising a tensioning lever for movement between a yarn-tensioning position and a yarn-releasing position;

a cam follower lever mounting said tensioning lever thereon;

a pair of follower rolls rotatably mounted on said follower lever;

a pair of cams, each said cam having a control surface for guiding a respective roll thereon; and at least one adjusting element between said cams for controlling a movement of said tensioning lever, said element having a pair of cam segments, each said cam segment having a control surface defining a continuation of said control surface of a respective cam whereby movement of said adjusting element adjusts said pair of cam segments simultaneously relative to said pair of cams to vary said movement of said tensioning lever from one of said positions.

2. A device as set forth in claim 1 wherein one of said cams has a groove for determining a range of adjustment of said adjusting element and one of said cam segments has a pin extending therefrom into said groove.

3. A device as set forth in claim 1 comprising a pair of said adjusting elements disposed in concentric relation with one adjusting element controlling the movement of said tensioning lever from said yarn-tensioning position and the other adjusting element controlling the movement of said tensioning lever from said yarn-releasing position.

4. A weft yarn tensioning device for a weaving machine comprising a tensioning lever for pivoting movement between a yarn-tensioning position and a yarn-releasing position;

a cam follower lever mounting said tensioning lever therein;

a pair of follower rolls rotatably mounted on said follwer lever;

a cam assembly for pivoting said cam follower lever to move said tensioning lever between said positions, said cam assembly including a drive shaft, a pair of cams mounted on said drive shaft, each said cam having a control surface for guiding a respective roll thereon and at least one adjusting element between said cams and about said shaft, said element having a pair of cam segments for adjusting the point of movement of said tensioning lever from one of said positions to the other of said positions, each said cam segment having a control surface defining a continuation of said control surface of a respective cam whereby movement of said adjusting element adjusts said pair of cam segments simultaneously relative to said pair of cams to vary said movement of said tensioning lever from one of said positions.

5. A device as set forth in claim 4 wherein said element is rotatably adjustable about said drive shaft relative to said cams to adjust said point of movement.

6. A device as set forth in claim 5 which further comprises means for limiting relative movement between said adjusting element and said cams.

7. A device as set forth in claim 5 which further comprises means for limiting relative movement between said adjusting element and said cams.

8. A device as set forth in claim 5 comprising a pair of said adjusting elements disposed in concentric relation about said drive shaft and between said cams with one adjusting element controlling the movement of said tensioning lever from said yarn-tensioning position and the other adjusting element controlling the movement of said tensioning lever from said yarn-releasing position.

* * * * *

UNITED STATES PATENT AND TRADEMARK OFFICE

CERTIFICATE OF CORRECTION

PATENT NO. : 4,577,666

DATED : March 25, 1986

INVENTOR(S) : JOSEF KATHRINER

Figure 3:
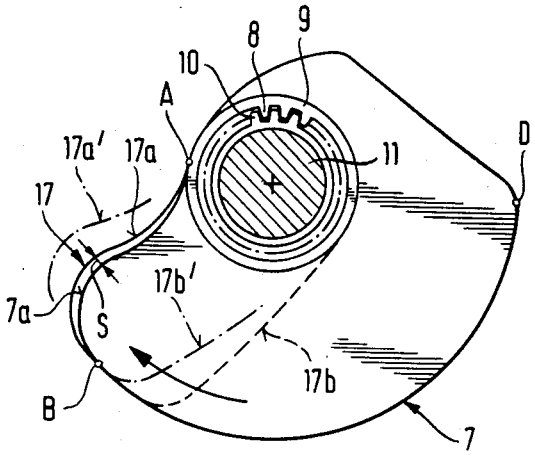
FIG. 3 illustrates a view taken on line III—III of FIG. 2.

It is certified that error appears in the above-identified patent and that said Letters Patent is hereby corrected as shown below:

Column 3, line 12 "Fig. 2" to -Fig. 3-

Column 4, line 8 change "wherein reference" to -wherein like reference-

Column 5, line 23 change "follwer" to -follower-

Signed and Sealed this

Twenty-eighth Day of October, 1986

[SEAL]

*Attest:*

DONALD J. QUIGG

*Attesting Officer* *Commissioner of Patents and Trademarks*